US006517684B1

(12) United States Patent
Juul

(10) Patent No.: US 6,517,684 B1
(45) Date of Patent: Feb. 11, 2003

(54) METHOD OF PRODUCING MOULDED PULP ARTICLES WITH A HIGH CONTENT OF DRY MATTER

(75) Inventor: Niels Juul, Herlev (DK)

(73) Assignee: Brodrene Hartmann A/S, Lyngby (DK)

( * ) Notice: Subject to any disclaimer, the term of this patent is extended or adjusted under 35 U.S.C. 154(b) by 0 days.

(21) Appl. No.: 09/857,627

(22) PCT Filed: Jan. 31, 2000

(86) PCT No.: PCT/DK00/00039

§ 371 (c)(1),
(2), (4) Date: Jun. 7, 2001

(87) PCT Pub. No.: WO00/46447

PCT Pub. Date: Aug. 10, 2000

(30) Foreign Application Priority Data

Feb. 2, 1999 (EP) ..... 99102042

(51) Int. Cl.[7] ..... D21J 7/00

(52) U.S. Cl. ..... 162/226; 162/228; 162/391; 264/87

(58) Field of Search ..... 162/218–230, 162/382–416; 264/86, 87; 249/117, 141, 137

(56) References Cited

U.S. PATENT DOCUMENTS

| | | | | | |
|---|---|---|---|---|---|
| 1,415,649 | A | * | 5/1922 | Jagenburg | 162/407 |
| 1,697,244 | A | * | 1/1929 | Kennedy | 162/226 |
| RE17,303 | E | * | 5/1929 | Keenan et al. | 162/226 |
| 1,848,055 | A | * | 1/1932 | Chaplin | 162/226 |
| 1,880,458 | A | * | 10/1932 | Morris | 162/192 |

* cited by examiner

*Primary Examiner*—Steven P. Griffin
*Assistant Examiner*—Eric Hug
(74) *Attorney, Agent, or Firm*—Larson & Taylor PLC

(57) ABSTRACT

Method of manufacturing articles from an aqueous fibre suspension, by deposition of fibres on a suction mould (2), comprising the steps of: applying suction to the suction mould, supplying a fibre suspension to the mould by immersing the suction mould in a vat (5) containing the fibre suspension, raising the suction mould from the fibre suspension, flowing ambient air by said suction through an article formed by a layer of fibre material deposed on the suction mould, characterised by the steps of: providing a substantially hermetically sealed space over the article or articles on the suction mould, supplying a de-watering fluid to the sealed space, and flowing substantially exclusively the de-watering fluid through the article or articles.

34 Claims, 7 Drawing Sheets

METHOD OF PRODUCING MOULDED PULP ARTICLES WITH A HIGH CONTENT OF DRY MATTER

TECHNICAL FIELD

The present invention relates to a method of producing moulded pulp articles by deposition of fibres on a respective suction mould such that the moulded pulp articles have a high content of dry matter when leaving the suction wheel and to an apparatus for carrying out the method. In this connection the term "pulp" is to be understood as applying to a fibre containing pulp mass, that may also contain or constitute of waste paper.

BACKGROUND ART

Document U.S. Pat. No. 3,654,076 discloses a method of continuous mass production of articles from pulp material using a moulding machine with a rotatable mould carrier, on the periphery of which suction moulds are placed side by side. The moulded pulp articles are formed by immersing the suction moulds into a vat of suspended pulp material while suction is applied in order to form a body of pulp in the shape of the desired article by fibre deposition. The suction mould is then withdrawn from the vat of suspended pulp material, and the suction is generally continued to compact the deposited fibres while exhausting residual liquid therefrom. The moist moulded articles are removed from the suction mould, partly by blowing air through the suction mould, and partly by aspirating the articles onto a corresponding transfer rotor. From the transfer rotor, the articles are placed onto supporting and conveying means adapted to convey the articles to a drying oven for a drying process. The moulded articles have, when leaving the suction mould, a relatively low dry matter content, which is typically about 25 weight %. A dry matter content of about at least 90 weight % has to be achieved by drying the articles in a drying oven. The low initial dry content of the articles when leaving the suction mould results in a high amount of energy used for drying the articles in the oven. Moreover, the articles with their low dry content are difficult to handle due to their low form stability, i.e. they need to be handled carefully.

U.S. Pat. No. 4,448,640 discloses a method of continuous mass production of articles from pulp material using a moulding machine with a rotatable mould carrier according to the above described principles which is provided with a stationary hood that roughly encapsulates a part of the rotatable mould carrier. This arrangement allows to flow a mixture of hot air or humid hot air and ambient air through the articles on the suction moulds.

DISCLOSURE OF THE INVENTION

On the above background it is the object of the present invention to provide a method of the kind referred to initially, with which it is possible to produce articles with a high dry matter content when leaving the suction mould. The advantages of a high dry content are a better form stability resulting in easier handling of the articles in following production steps, such as e.g. after-pressing and a reduction in the energy needed to dry the articles. This object is achieved with the method by delivering a de-watering fluid to a substantially hermetically sealed space over the article, whereby it is possible to flow de-watering fluid through the article which is not mixed with ambient air and thus achieve a substantially improved de-watering effect leading to a higher dry matter content of the moulded pulp articles.

The present invention also relates to an apparatus to carry out the above-mentioned method. By providing a hood over the suction moulds or the mould carrier in combination with gaskets sealing between the moulds and the hood or hoods, a space over the article can be efficiently sealed from the ambient air. By delivering a de-watering fluid to the encapsulated space over the mould surface, only the de-watering fluid is flowed by suction through the moulded pulp articles on the mould without ambient air being mixed into the de-watering fluid.

It is a further object of the invention to provide a method of the kind referred to initially in which steam is used as a de-watering fluid.

BRIEF DESCRIPTION OF THE DRAWINGS

In the following detailed portion of the description the invention will be explained in more detail with reference to the drawings, in which FIG. 1 diagrammatically shows an embodiment of a pulp moulding machine, a conveyor system and a drying oven.

DESCRIPTION OF THE PREFERRED EMBODIMENT

Figure 1:
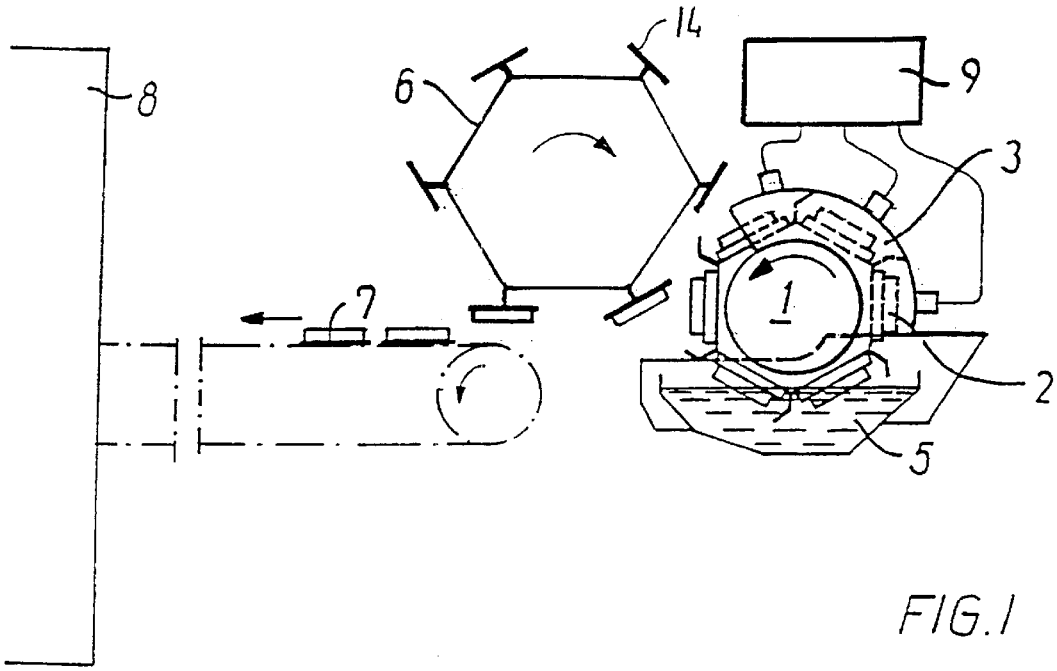

FIG. 1 shows diagrammatically a suction moulding station for moulding articles from pulp material. The station comprises a rotatable mould carrier 1, on the outside of which are placed several liquid-permeable suction moulds 2 adapted to be connected with a source of sub-atmospheric and to a source of super-atmospheric pressure. The mould carrier 1 is with a part of its circumferential surface immersed in a pulp vat 5 containing a fibre pulp suspension. This pulp may be made from a fibre-containing raw material, including waste paper or cardboard. During the immersion in the pulp mass, a layer of fibre material is deposited by suction on the mould surfaces of the suction mould 2. Subsequently, when the moulds 2 are withdrawn from the fibre suspension in the pulp vat 5, the suction is continued to compact the deposited fibres while exhausting residual liquid therefrom. After withdrawing the mould from the pulp vat 5, the mould will follow the rotary trajectory of the rotatable mould carrier 1 and thereby pass under a hood 3 which in sealing interaction with gaskets 4 placed on the rotatable mould carrier 1 seals off the mould surface from the ambient air. A de-watering fluid is introduced in the sealed-off space between the hood 3 and the suction mould 2, whilst the source of sub-atmospheric pressure is connected to the mould 2. The de-watering fluid is thus flowed through the freshly moulded article on the mould surface. The article is thereby de-watered, and dry matter content of the article is increased. After withdrawing the mould 2 from the pulp vat 5 and before supplying the de-watering fluid, water is sprayed on the articles in order to remove residual pulp.

The articles are typically 3D-moulded pulp packaging such as fruit and egg trays. These articles have a relatively thin wall of fibre material.

The hood 3 may cover a substantial section of the rotatable mould carrier 1 in order to provide enough time for the de-watering fluid to flow through the moulded articles. After passing under the hood 3, the moulds 2 are rotated further to engage a transfer rotor 6 which is placed with its axis parallel to the axis of the rotatable mould carrier 1 and facing the latter's periphery. From the suction mould 2 on the rotatable mould carrier 1 the fibre layer having been deposited by suction is blown off by supplying air under pressure to the latter coming from the source of super-atmospheric pressure. At the same time, the moist article is being aspirated on to transfer moulds 14 on the transfer rotor 6. From the transfer rotor 6 the moist article is blown off and laid on to a conveying track 7, on which the article is conveyed through a drying oven 8. From the drying oven 8, the substantially or completely dried article is placed on a conveying surface (not shown), from which it is conveyed up to and passes a number of after-treatment stations (not shown) for completing its processing.

Figure 2:
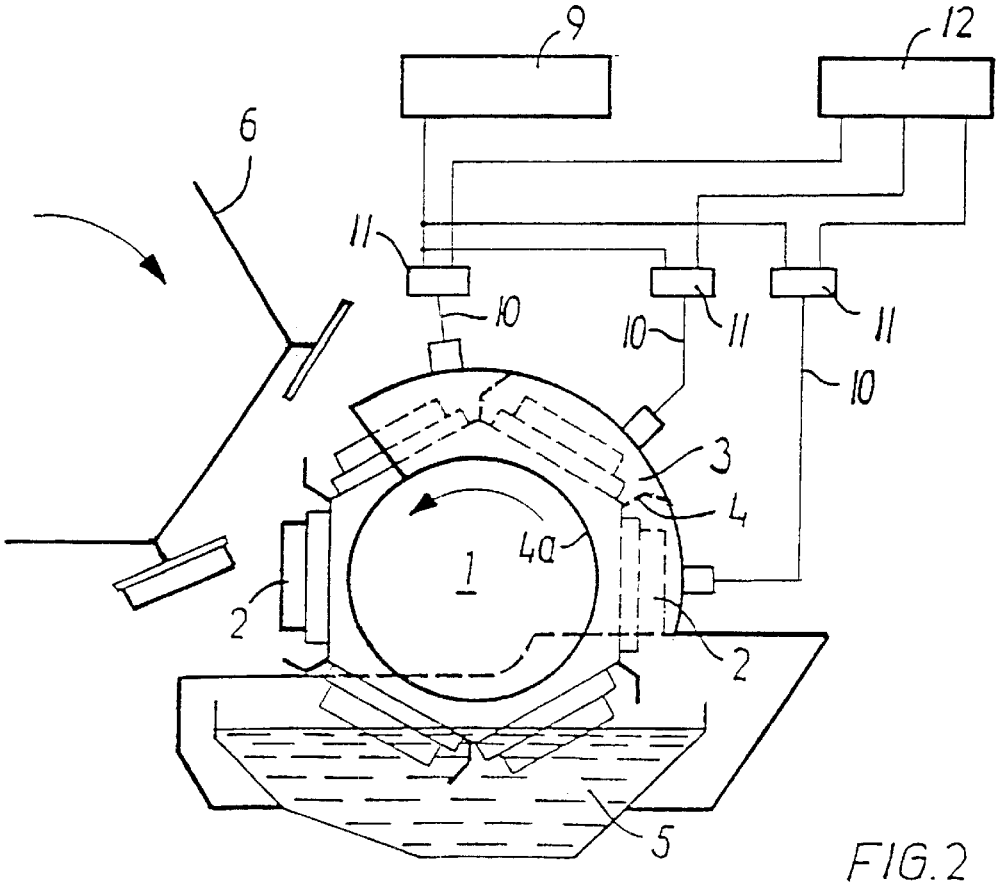
FIG. 2 shows a detailed view of the rotating mould carrier and the hood.
Figure 3:
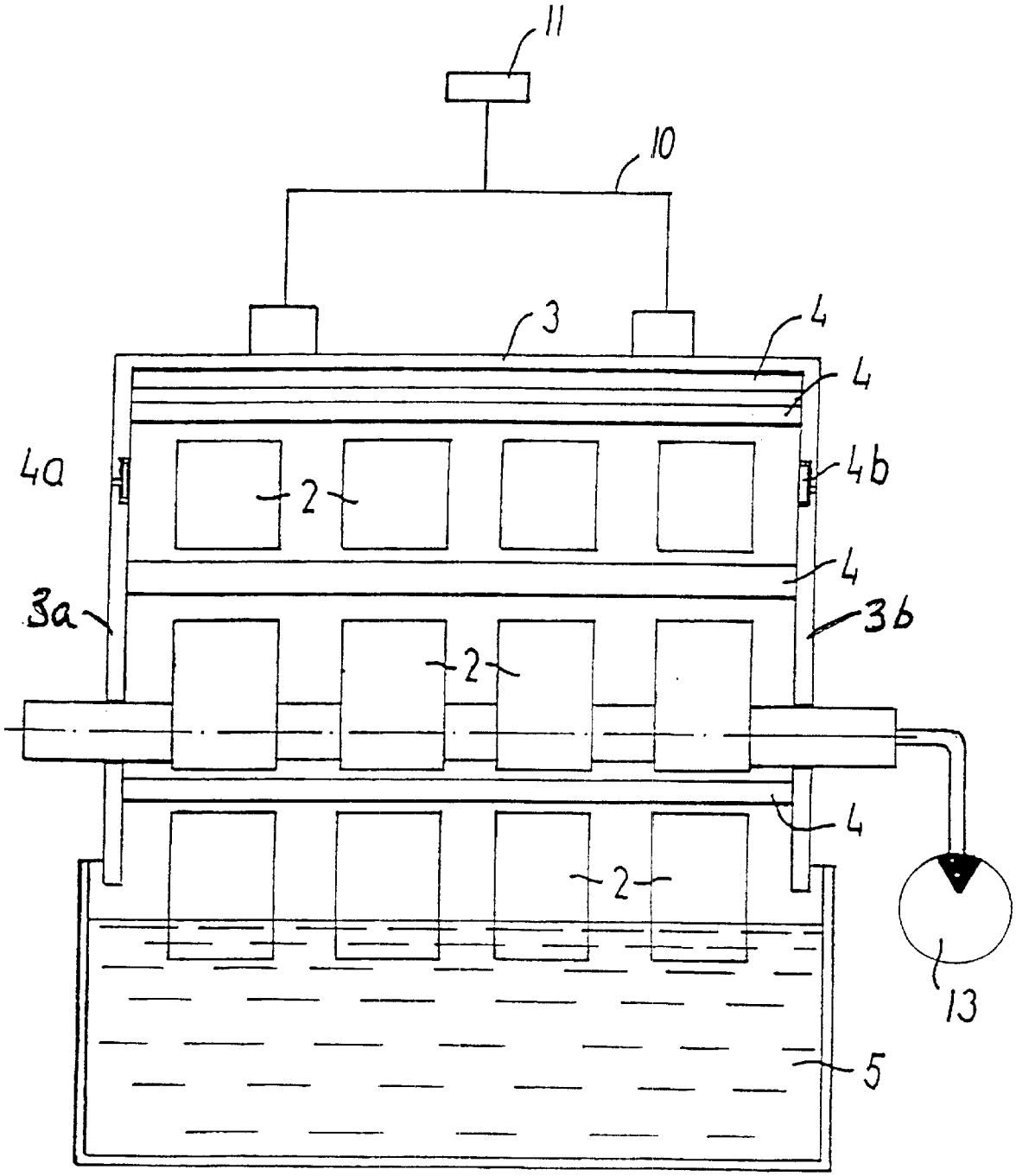
FIG. 3 shows a view of the rotatable mould carrier and the hood lateral to the view of FIG. 2.

FIG. 2 shows a detailed view on the side of the hood 3 covering a sector of the rotatable mould carrier 1. The coverage of the hood 3 starts just above the point where the moulds leave the pulp vat and extends over the approximately a quarter of the circumference of the rotatable mould carrier 1 and ends before the transfer rotor 6. The hood 3 comprises a curved wall extending over the width of the rotatable mould carrier. The curved wall of the hood 3 follows an arc with its center of rotation falling together with the axis of the rotatable mould carrier 1 (FIG. 3). At least two side walls 3*a,* 3*b* extend substantially perpendicularly from the curved wall along the sides of the rotatable mould carrier 1 towards the axis of the latter. The side walls of the hood are provided with gaskets 4*a,* preferably in the form of a labyrinth sealing, that sealingly interact with the side walls of the rotatable mould carrier, or vice versa. The curved wall of the hood is in sealing contact with gaskets 4 placed on the rotatable mould carrier 1 before and after each suction mould or group of suction moulds. The gaskets 4 extend in a direction substantially parallel to the axis of the rotatable mould carrier. The rotatable mould carrier 1 is thus divided by gaskets 4 into groups of single or groups of several moulds 2. When passing under the hood 3, an encapsulated space is formed over each of the moulds 2 or group of moulds between two gaskets 4. A source of de-watering fluid 9 is connected to the hood 3 by a conduit 10 leading the de-watering fluid under the curved surface of the hood. The de-watering fluid is supplied at a pressure higher than that of the sub-atmospheric source of pressure. A valve 11 is placed in the conduit 10 delivering the de-watering fluid to the hood, so that the delivery of the de-watering fluid can be controlled. The delivery conduit 10 may be split into several conduits each comprising a valve 11, so that a controlled delivery to different parts of the hood 3 is possible in accordance with suction moulds 2 passing under the hood. The inlet openings in the hood 3 for entry of the de-watering fluid are preferably concentrated towards the side of the hood 3 where the suction moulds 2 come in. The pressure of the de-watering fluid delivered to the hood can be varied and is in a range of 0.1 to 12 bars; preferably 0.5 to 2 bars. When a suction mould 2 or a group of suction moulds is under the hood 3 and forms the sealed chamber, the valve 11 is opened and the de-watering fluid enters the encapsulated space over the mould or moulds, whereupon it is sucked through the moulded pulp article on the mould 2, thereby de-watering the latter. After passing the hood 3, the moulds 2 are further rotated to the position where the articles are blown off from the suction moulds 2 and aspirated on to the transfer rotor 6. After a part of a revolution of the transfer rotor the articles are blown off therefrom onto a conveyor 7 which transports the articles to a drying oven for a drying procedure. In the drying oven, the articles reach their final dry matter weight content of at least 90 weight per cent.

The dry weight content of the articles when they are blown off from the suction mould depends on the kind of de-watering agent that is used. The de-watering fluid can be delivered in the form of a vapour. According to a preferred embodiment of the present invention, the de-watering agent is steam. Steam with a temperature of up to 300° C. has a better drying effect than hot air. This effect is, however, minimised when ambient air is mixed in together with the steam. The steam has preferably a temperature in the range between 100 and 150° C. Other de-watering fluids such as heated and/or compressed air, or other gases suitable for dehydration are used in an other embodiment of the invention.

The valves in the conduit leading the de-watering fluid to the hood are preferably of an electromagnetic type so as to allow control from a logic control unit. The logic control unit may be integral with a logic control unit steering the complete production process. The logic control unit can be programmed to choose the amount of de-watering fluid, as well as its pressure and the time of delivery. In particular such choice may be made automatically under consideration of other process parameters such as the production speed. The use of valves can be avoided if a constant flow is wanted.

Before supplying the de-watering agent, water may be sprayed on the articles as they leave the pulp vat in order to remove any residual pulp on places where pulp deposition is not desired.

By adjusting the size of the sector of the rotatable mould carrier which is enclosed by the hood, the time available for the de-watering fluid to pass through the articles can be adjusted according to circumstances. In a mass production moulding machine the speed of rotation of the rotatable mould carrier is relatively high. Typically there are only a few seconds available for passing the de-watering fluid through the freshly moulded article. Therefore, the present invention offers a great advantage in improving this part of the moulding procedure.

If necessary, the opening and closing of the electric valves 11 is controlled by a PLC 12. The PLC may also be used for controlling other process parameters.

Figure 4:
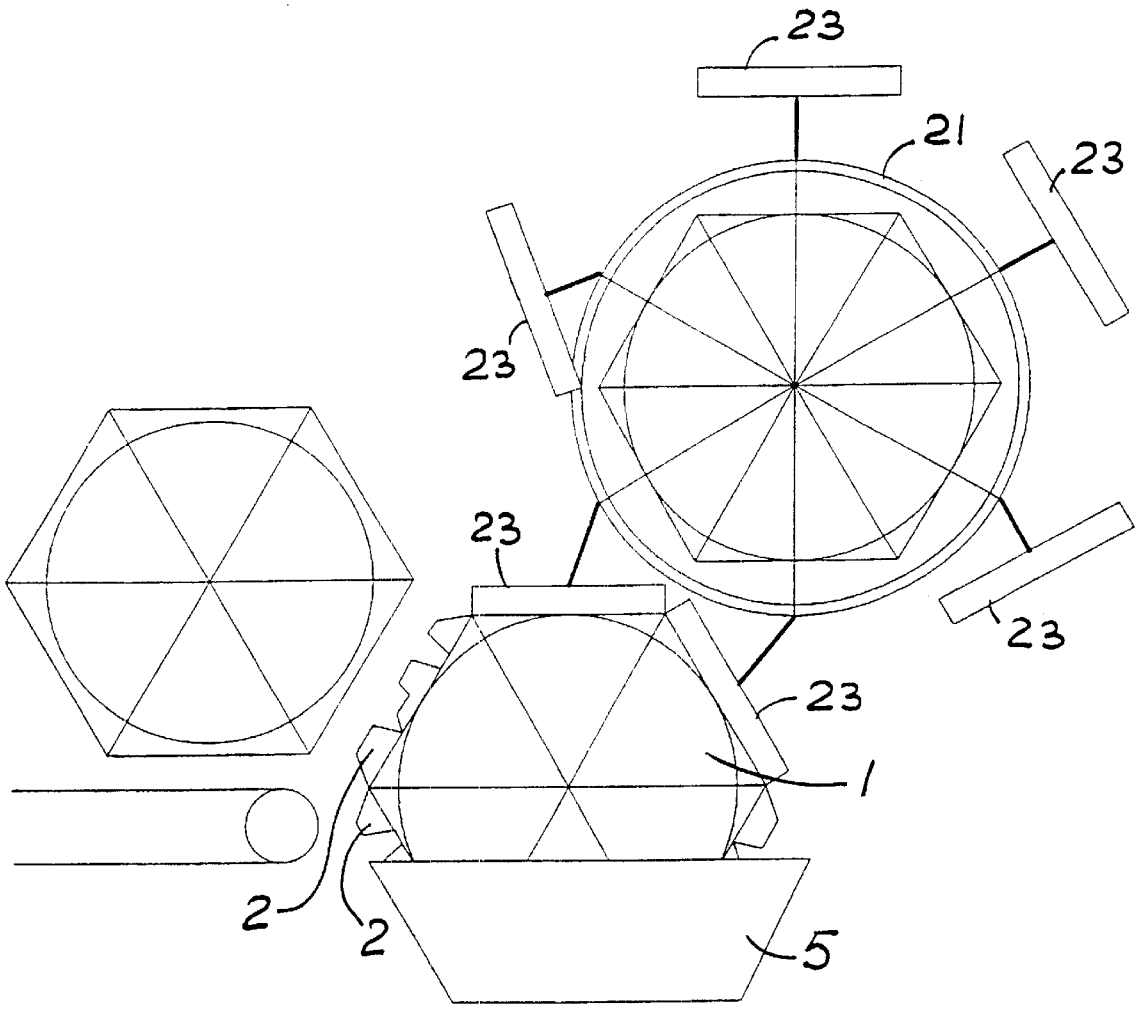
FIG. 4 diagrammatically shows a second embodiment of the invention.

The second embodiment of the invention as shown in FIG. 4, comprises a number of movable hoods 23 coupled to a movable hood carrier 21 which rotates synchronously with the rotatable mould carrier 1. The movable hoods 23 engage with the suction moulds 2 on the rotatable mould carrier 1 in order to form a hermetically sealed space over the articles on the suction moulds 2. The movable hoods 23 are provided with gaskets (not shown) that come into sealing abutment with the suction mould 2 or the rotatable mould carrier 1 in order to provide for a hermetic sealing. The advantage of this embodiment is that there is stationary sealing abutment between the hood 23 and the suction mould 2.

Figure 5:
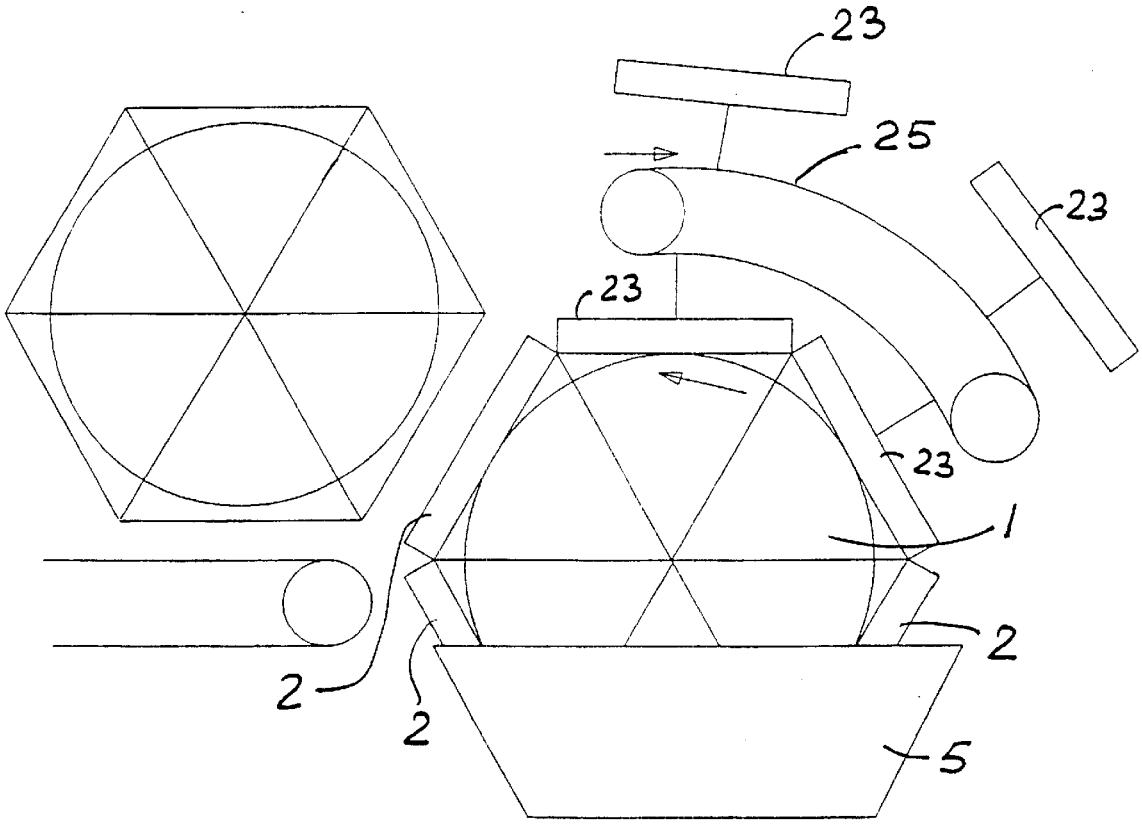
FIG. 5 diagrammatically shows a third embodiment of the invention.

The third embodiment of the invention as shown in FIG. 5 is in principle substantially equal to the embodiment according to FIG. 4, but instead of a rotatable hood carrier, a conveyor belt 25 is used to move the movable hoods 23, by coupling them to the conveyor belt 25. The conveyor belt 25 runs along a curved path forming an arc of a circle with its centre at the axis of the rotatable mould carrier 1.

Figure 6:
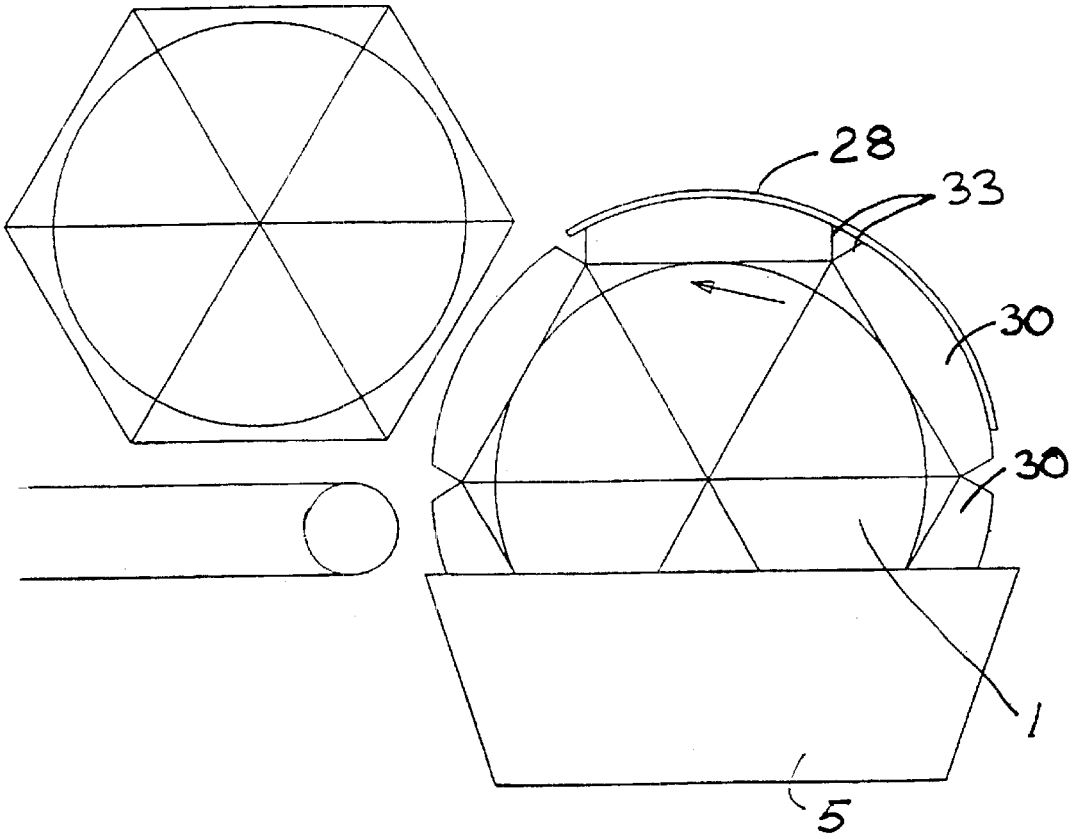
FIG. 6 diagrammatically shows a fourth embodiment of the invention.

The fourth embodiment of the invention as shown in FIG. 6 comprises a stationary hood in the form of a curved plate 28 extending along an are of a circle with its centre at the axis of the rotatable mould carrier 1. Each of the suction moulds 2 is surrounded by radially extending sealing plates 30, 33. The plates 30 which extend parallel with the direction of the rotational movement of the rotatable mould carrier 1 have a circumferential rim which co-operates with the curve plate 28 to form a hermetical seal, for example by using a labyrinth type seal. The sealing plates 33 which extend transversely to the rotational movement of the rotatable mould carrier 1 come into sealing abutment with the cured plate 28.

Figure 7:
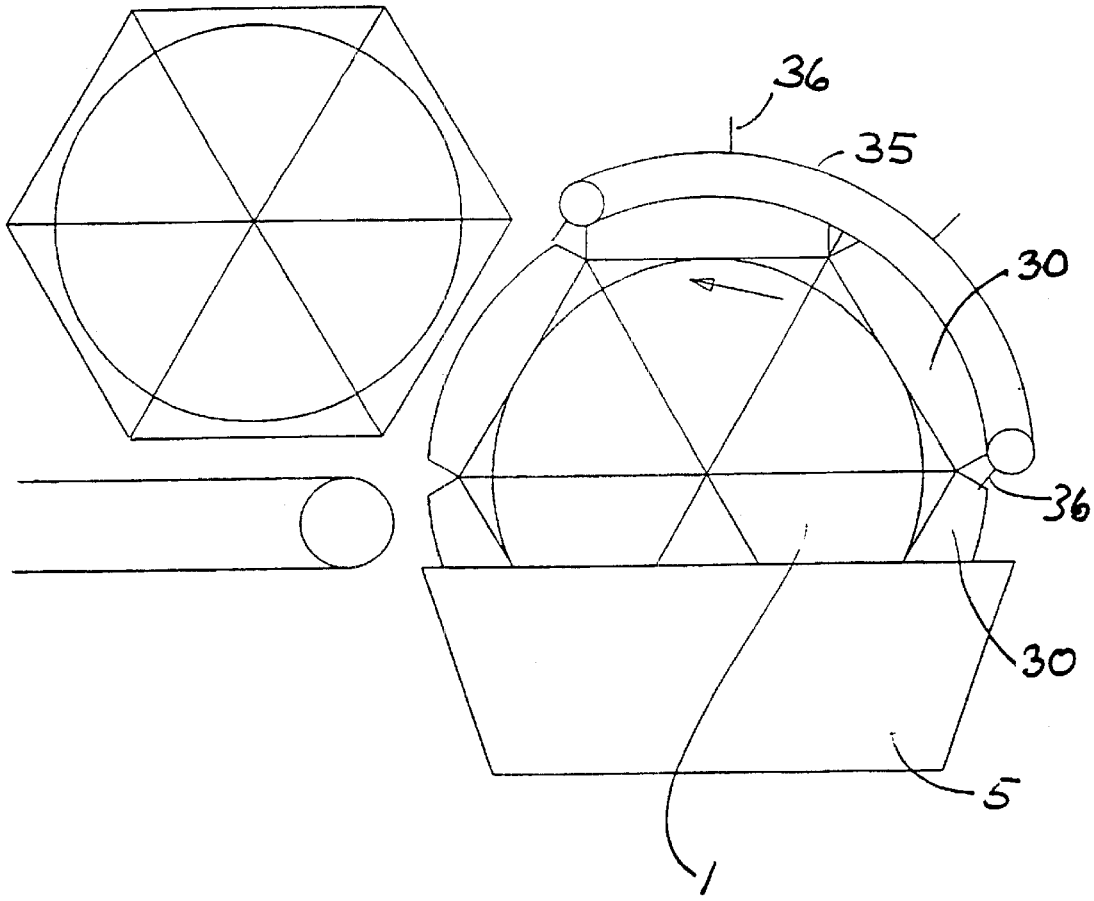
FIG. 7 diagrammatically shows a fifth embodiment of the invention.

The fifth embodiment of the invention as shown in FIG. 7, comprises a curved moving belt 35 instead of a curved plate 28. Thus, the sealing plates 30 with the curved rim can come into stationary contact with the belt 35 forming a sealing abutment. The belt 35 may be provided with sealing plates 36 which extend transversely to the direction of movement of the belt 35 and are spaced such that each of the suction moulds 2 is surrounded by sealing plates. This embodiment may instead comprise (not shown in FIG. 7) stationary sealing plates 33 arranged on the rotatable mould carrier 1 in order to surround the suction moulds with sealing plates. Thus, all sealing is by stationary abutment.

The belt 35 runs synchronously with the rotatable mould carrier 1 allowing stationary—abutment between the sealing plates 33 and the belt 35.

Figure 8:
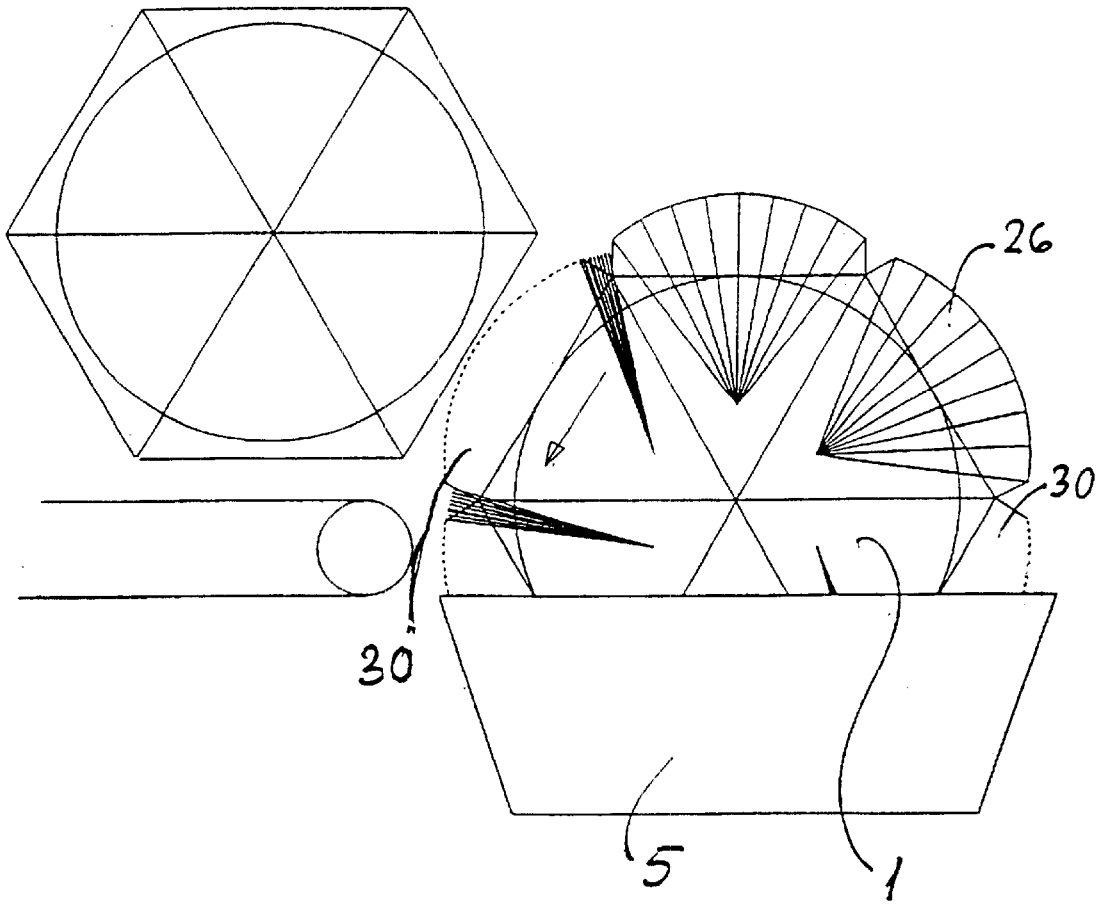
FIG. 8 diagrammatically shows a sixth embodiment of the invention.

The sixth embodiment according to the invention as shown in FIG. 8 comprises a foldable hood 26 associated with a suction mould 2 and arranged on the rotatable mould carrier 1. After the suction mould 2 has undergone a submergement into the pulp vat 5, the foldable hood is drawn over the suction mould 2 to seal it hermetically from the ambient air. The de-watering fluid is provided through a conduit (not shown) which is integrated in the rotatable mould carrier 1. When the de-watering fluid has passed the article, the foldable hood 26 is collapsed in order to uncover the suction mould 2 so that it is ready to be submerged in the pulp vat 5 again. The foldable hood co-operates with the radially extending sealing plates with a curved rim 30.

According to another embodiment (not shown), the mould carrier is a step-operating carrier that moves the mould carrier downwards to submerge the suction mould or moulds on the mould carrier in the pulp vat and moves upwards to retract the mould or moulds from the pulp vat. In this embodiment, the hood extends over one side of the mould carrier to define the sealed-off space.

Various modifications are possible within the scope of the invention as defined in the claims such as blowing the de-watering fluid through the article by applying an over-pressure in the sealed-off space over the article.

List of Parts 1 rotatable mould carrier
2 suction mould
3 hood
4 gasket
4*a* gasket
5 pulp vat
6 transfer rotor
7 conveyor
8 drying oven
9 source of de-watering fluid
10 conduit
11 valve
12 plc
13 source of sub-atmosphere pressure
14 transfer mould
21 rotatable hood carrier
23 movable hood
25 conveyor belt
26 foldable hood
28 curved plate
30 sealing plate with curved rim
33 sealing plate
35 belt
36 sealing plates

What is claimed is:

1. Method of manufacturing articles from an aqueous fiber suspension, by deposition of fibers on a suction mould, comprising the steps of:

applying suction to the suction mould, supplying a fiber suspension to the mould by immersing the suction mould in a vat containing the fiber suspension, raising the suction mould from the fiber suspension, flowing ambient air by said suction through an article formed by a layer of fiber material deposed on the suction mould, providing a substantially hermetically sealed space over the article or articles on the suction mould, supplying a de-watering fluid to the hermetically sealed space, and flowing substantially exclusively the de-watering fluid through the article or articles in the hermetically sealed space.

2. Method according to claim 1, characterized in that the suction mould is placed on a rotatable mould carrier.

3. Method according to claim 1, characterized in that the de-watering fluid is flowed by suction through the article when it is placed on the suction mould, and/or by applying over-pressure to the space over the article.

4. Method according to claim 2 characterized by providing a movable hood over each suction mould which moves together with such single suction mould over a certain distance of a rotational movement of the suction mould in order to define the sealed space over the article or articles.

5. Method according to claim 4, characterized in that the movable hoods (23) are coupled to a rotatable hood carrier moving synchronously with the rotatable mould carrier, or to a conveyor.

6. Method according to claim 1, characterized by the step of providing a stationary hood placed over a sector of the rotatable mould carrier to thereby seal-off one or more suction moulds from the ambient air and thus define the hermetically sealed space over the article or articles.

7. Method according to claim 1, characterized in that the de-watering fluid is steam, saturated steam or overheated steam.

8. Method according to claim 7, characterized in that the temperature of the steam is up to 300° C.

9. Method according to claim 8, characterized in that the temperature of the steam is in the range of between 100 and 150° C.

10. Method according to claim 1, characterized in that pressure of the de-watering fluid is supplied with an over-pressure in the range of 0.1 to 12 bar.

11. Method according to claim 10, characterized in that pressure of the de-watering fluid is supplied with an overpressure in the range of 0.5 to 2 bar.

12. Method according to claim 1, characterized in that the de-watering fluid is heated and/or compressed air.

13. Method according to claim 1, characterized in that the de-watering fluid is applied for a period of 0.1 to 10 seconds.

14. Method according to claim 13, characterized in that the de-watering fluid is applied for a period of 0.1 to 1.0 seconds.

15. Apparatus for manufacturing articles from an aqueous fiber suspension by deposition of fibers on a suction mould comprising:

a rotatable mould carrier provided with at least one suction mould on a periphery of the rotatable mould carrier, a vat containing an aqueous fiber suspension in which the rotatable mould carrier is partially submerged, a source of sub-atmospheric pressure connectable to the at least one suction mould, means for covering one or more moulds in a sector of the rotatable mould carrier to thereby define an encapsulated space over the mould or moulds that is substantially hermetically sealed from the ambient air, and a means for providing a de-watering fluid to the encapsulated space such that substantially only de-watering fluid is drawn through the mould or moulds.

16. Apparatus according to claim 15, characterized by at least two transverse gaskets extending radially with respect to the rotatable mould carrier and spaced circumferentially with one or more suction moulds between them.

17. Apparatus according to claim 16, characterized by comprising a stationary hood having an arc-shaped wall with which the gaskets come in sealing contact to define a sealed-off space to which the de-watering fluid can be supplied.

18. Apparatus according to claim 17, characterized in that two side walls extend substantially perpendicularly from the curved wall of the hood towards the rotatable mould carrier.

19. Apparatus according to claim 18, characterized by comprising gaskets, provided on each side wall of the hood and co-operating with a peripheral element of the rotatable mould carrier.

20. Apparatus according to claim 19, wherein the gaskets are labyrinth gaskets.

21. Apparatus according to claim 15 characterized by comprising a movable hood over each suction mould which moves together with such single suction mould over a certain sector of the rotational movement of the suction mould in order to define the sealed space over the article or articles.

22. Apparatus according to claim 21, characterized in that each movable hood is coupled to a rotatable hood carrier moving synchronously with the rotatable mould carrier.

23. Apparatus according to claim 21, characterized in that the movable hoods are coupled to a conveyor moving synchronously with the rotatable mould chamber.

24. Apparatus according to claim 15, characterized by comprising a stationary hood placed over a sector of the rotatable mould carrier to thereby seal-off one or more suction moulds from the ambient air and thus define the encapsulated space over the article or articles, and whereby gaskets are provided between the stationary hood and the rotatable mould carrier.

25. Apparatus according to claim 24, characterized in that the de-watering fluid is supplied to at least one de-watering inlet opening in the stationary hood.

26. Apparatus according to claim 25, characterized in that several de-watering inlet openings are distributed over the stationary.

27. Apparatus according to claim 26, characterized in that the de-watering inlet openings are concentrated at the end of the stationary hood where the suction moulds enter.

28. Apparatus according to claim 17 characterized in that the stationary hood is formed by a curved plate extending along an arc of a circle with its center at the axis of the rotatable mould carrier.

29. Apparatus according to claim 28, characterized in that the rotatable mould carrier is equipped with a number of sealing plates having a circular rim co-operating with the curved plate to create a sealed-off space.

30. Apparatus according to claim 21 characterized in that the movable hood is formed by a belt moving along a curved trajectory extending along an arc of a circle with its center at the axis of the rotatable mould carrier wherein the belt is provided with transversally extending sealing plates which seal before and after a suction mould.

31. Apparatus according to claim 20, characterized in that the rotatable mould carrier is equipped with a number of sealing plates having a circular rim co-operating with the belt to create a sealed-off space.

32. Apparatus according to claim 15, characterized in that the suction moulds are surrounded by radially extending gaskets or sealing plates that co-operate with the curved plate or the belt to define a sealed-off space.

33. Apparatus according to claim 15, characterized by comprising one or more electrically controlled valves regulating the delivery of the de-watering fluid.

34. Apparatus for manufacturing articles from an aqueous fiber suspension by deposition of fibers on a suction mould comprising:

a rotatable mould carrier provided with at least one suction mould on a periphery of the rotatable mould carrier, a vat containing an aqueous fiber suspension in which the rotatable mould carrier is partially submerged, a source of sub-atmospheric pressure connectable to the at least one suction mould, means for covering one or more moulds in a sector of the rotatable mould carrier to thereby define an encapsulated space over the mould or moulds that is substantially hermetically sealed from the ambient air, said covering means including a stationary hood having an arc-shaped wall, and gaskets which come in sealing contact with the stationary hood to define the encapsulated space, and a means for providing a de-watering fluid to the encapsulated space such that substantially only de-watering fluid is drawn through the mould or moulds.

* * * * *